US006095520A

United States Patent [19]

Willkow

[11] Patent Number: 6,095,520

[45] Date of Patent: Aug. 1, 2000

[54] RANDOM TRUMP SELECTOR

[76] Inventor: James A. Willkow, 208 Lycoming Rd., Buffalo Mills, Pa. 15534

[21] Appl. No.: 09/189,862

[22] Filed: Nov. 12, 1998

Related U.S. Application Data

[60] Provisional application No. 60/069,337, Dec. 11, 1997.

[51] Int. Cl.[7] ..... A63F 1/06; A63F 1/18

[52] U.S. Cl. ..... 273/141 R; 273/148 R; D21/374

[58] Field of Search ..... 273/141 R, 148 R; D21/374

[56] References Cited

U.S. PATENT DOCUMENTS

| | | | |
|---|---|---|---|
| 681,528 | 8/1901 | Cochrane | 273/148 R |
| 1,363,750 | 12/1920 | Pink | 273/141 R |
| 3,647,217 | 3/1972 | Williams, Jr. et al. | 273/141 R |
| 5,375,845 | 12/1994 | Cooter et al. . | |
| 5,607,161 | 3/1997 | Skratulia . | |
| 5,607,162 | 3/1997 | Boylan et al. . | |
| 5,632,489 | 5/1997 | Rozzi, Sr. et al. . | |
| 5,664,781 | 9/1997 | Feola . | |
| 5,762,334 | 6/1998 | Kosi | 273/148 R |

FOREIGN PATENT DOCUMENTS

| | | |
|---|---|---|
| 2184029 | 6/1987 | United Kingdom . |
| 2040694 | 9/1998 | United Kingdom . |

*Primary Examiner*—Benjamin H. Layno
*Attorney, Agent, or Firm*—Richard C. Litman

[57] ABSTRACT

A device for randomly selecting and illustrating a trump suit for a card game. A spinner is used to point out a trump suit as marked on a flat planar member. The device may also be provided with a marker to track the number of cards dealt in the current hand. A method for playing a card game using the device where from 2 to 7 players may play the game. A series of hands are played, wherein each player is first dealt 7 cards and 1 less card for each subsequent hand. Each hand consists of a series of tricks where each player throws one card, following the suit led if possible. The player who takes the trick, by throwing the highest ranked card, leads the next trick. A series of tricks are played until all cards have been thrown, signalling the end of the hand. Any player who took at least one trick remains to play another hand which is dealt by the winner of the previous hand. The dealer also selects trump, after examining his hand. Hands are played until only one player, the winner, remains.

3 Claims, 4 Drawing Sheets

RANDOM TRUMP SELECTOR

CROSS-REFERENCE TO RELATED APPLICATION

This application claims the benefit of U.S. Provisional Patent Application Ser. No. 60/069,337, filed Dec. 11, 1997.

BACKGROUND OF THE INVENTION

1. Field of the Invention

The present invention relates to card games and, more specifically, to a device for randomly selecting a higher ranked trump suit and a method of playing a card game using trump.

2. Description of Related Art

Many card games are known and played which use a trump suit, one that is ranked higher than the other suits. An often asked question by players in one of these games is "what's trump?" Therefore, a device for tracking the trump suit would therefore be beneficial. Moreover, such a device could also be used to randomly select trump in a card game in addition to being a memory aid.

Avid card players are often looking for new challenges and new games. A new card game employing strategy, chance, and luck that is easy to learn and play is therefore always needed. A game that is easy to play and does not use score keeping is especially needed to help prepare future card players. Despite previous efforts, the need still exists for a device for randomly selecting and tracking trump for use in conjunction with a new card game, that may be played by any skill level of card player.

Other card games are well known and have been the subject of previous patents. U.S. Pat. No. 5,375,845, which issued to Cooter, et al. on Dec. 27, 1994, discloses a bridge-type card game with variable trump suit and die. A game using a complicated scoring sheet and die for selecting trump is described where each subsequent hand in a series is dealt with one less card than the preceding hand.

U.S. Pat. No. 5,607,161, which issued to Skratulia on Mar. 4, 1997, discloses a method of playing an improved version of the game of Pai Gow poker. The game is played with a standard 52 card deck plus four jokers and a set of three special dice.

U.S. Pat. No. 5,607,162, which issued to Boylan et al. on Mar. 4, 1997, discloses a method of playing a matching card game. This game is played by matching a first card, either by suit or by rank.

U.S. Pat. No. 5,632,489, which issued to Rozzi, Sr. et al. on May 27, 1997, discloses a method of playing a seven and a half card game. The game is played with a modified deck of cards. The cards are marked from half a point to seven and a half. The object is for each player to have a higher point count than the dealer, but not more than seven and a half.

U.S. Pat. No. 5,664,781, which issued to Feola on Sep. 9, 1997, discloses a method and apparatus for playing a poker-type card game. The game allows player to wager against a casino based on the rules of stud poker.

Other card games are known, but are less related to the present invention. Among these are those disclosed in UK patent document 2,040,694 A (card game) published Sep. 3, 1980 and UK patent document 2,184,029 A (amusement or skill games with prizes machines) published Jun. 17, 1987.

Although many card games already exist, there is still a need for new and challenging games that are also easy to learn and play.

None of the above inventions and patents, taken either singly or in combination, is seen to describe the instant invention as claimed.

SUMMARY OF THE INVENTION

The present invention is a device for randomly selecting a trump suit for a card game. A spinner is used to point out a trump suit as marked on a flat planar member. The device may also be provided with a marker to track the number of cards dealt in the current hand. The spinner may also be used to point out the current trump suit even when trump is not randomly selected.

A method for playing a card game is also provided. A standard deck of cards are used to play the game. Anywhere from 2 to 7 players may play the game. A series of hands are played, wherein each player is first dealt 7 cards and 1 less card for each subsequent hand. Each hand consists of a series of tricks where each player throws one card, following the suit led if possible. The player who takes the trick, by throwing the highest ranked card, leads the next trick. A series of tricks are played until all cards have been thrown, signalling the end of the hand.

The player who took the most tricks wins the hand, and deals the next hand for which he may choose the trump suit. Play continues through a series of hands, each hand having one less trick, until only one player remains. The remaining player is declared the winner and the game ends.

Accordingly, it is a principal object of the invention to provide a device to easily select and display a trump suit for a card game.

It is another object of the invention to provide a card game that involves both skill and luck.

It is a further object of the invention to provide a card game that is easy to learn and play.

Still another object of the invention is to provide a card game where traditional scoring methods are not used.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
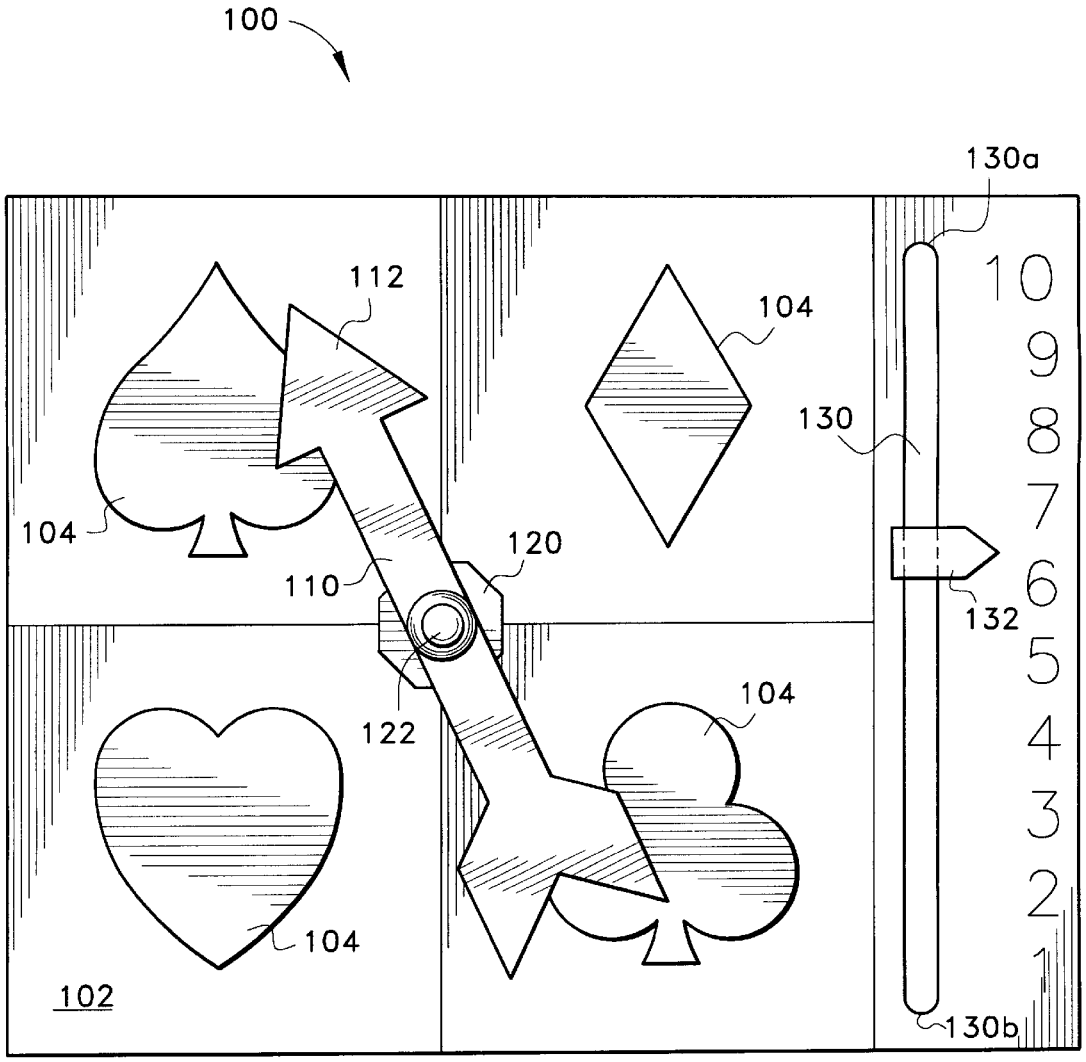
FIG. 1 is a top plan view of the trump selector of the present invention.
Figure 2:
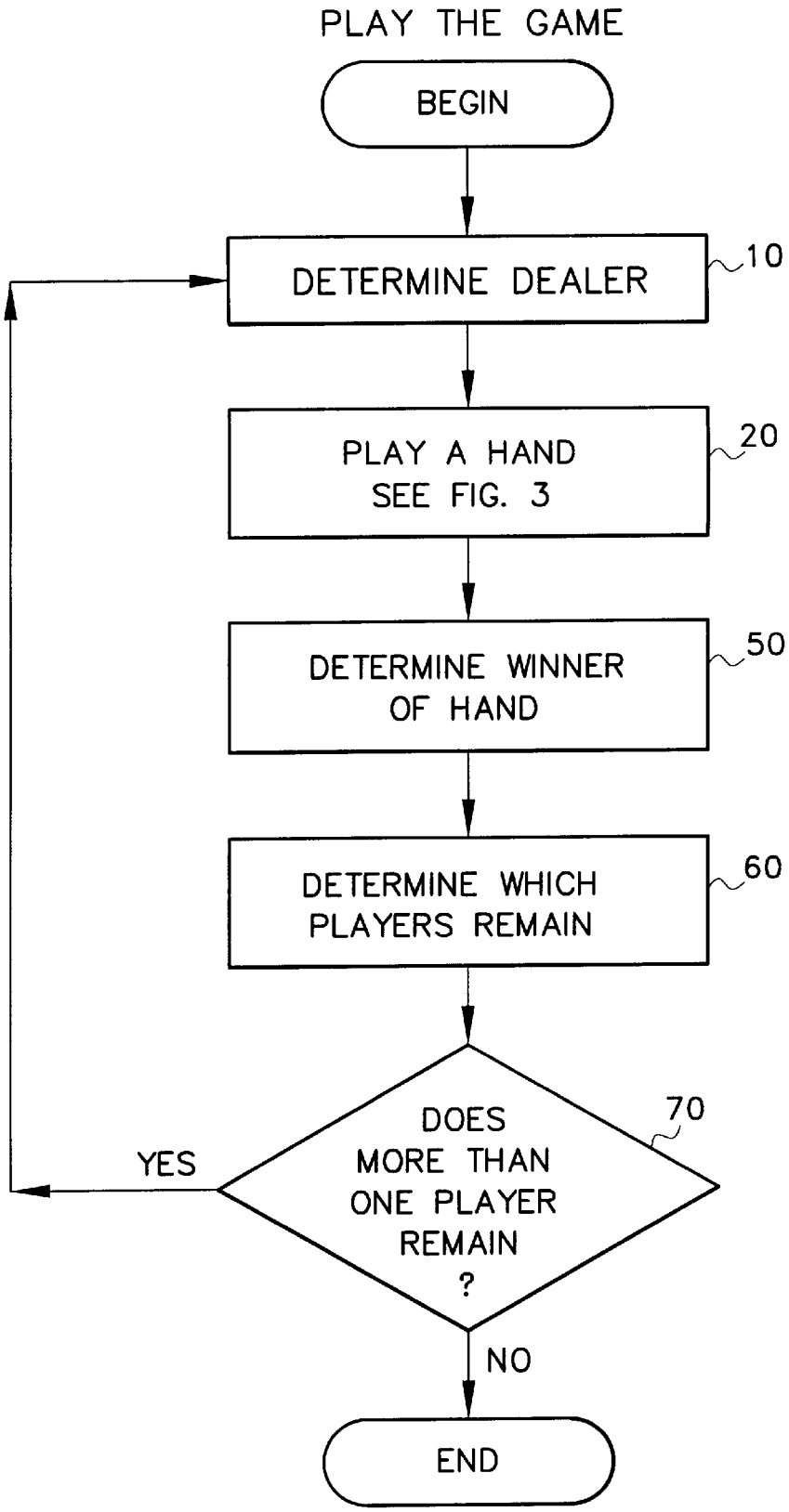
FIG. 2 is a flowchart of the card game of the present invention.
Figure 3:
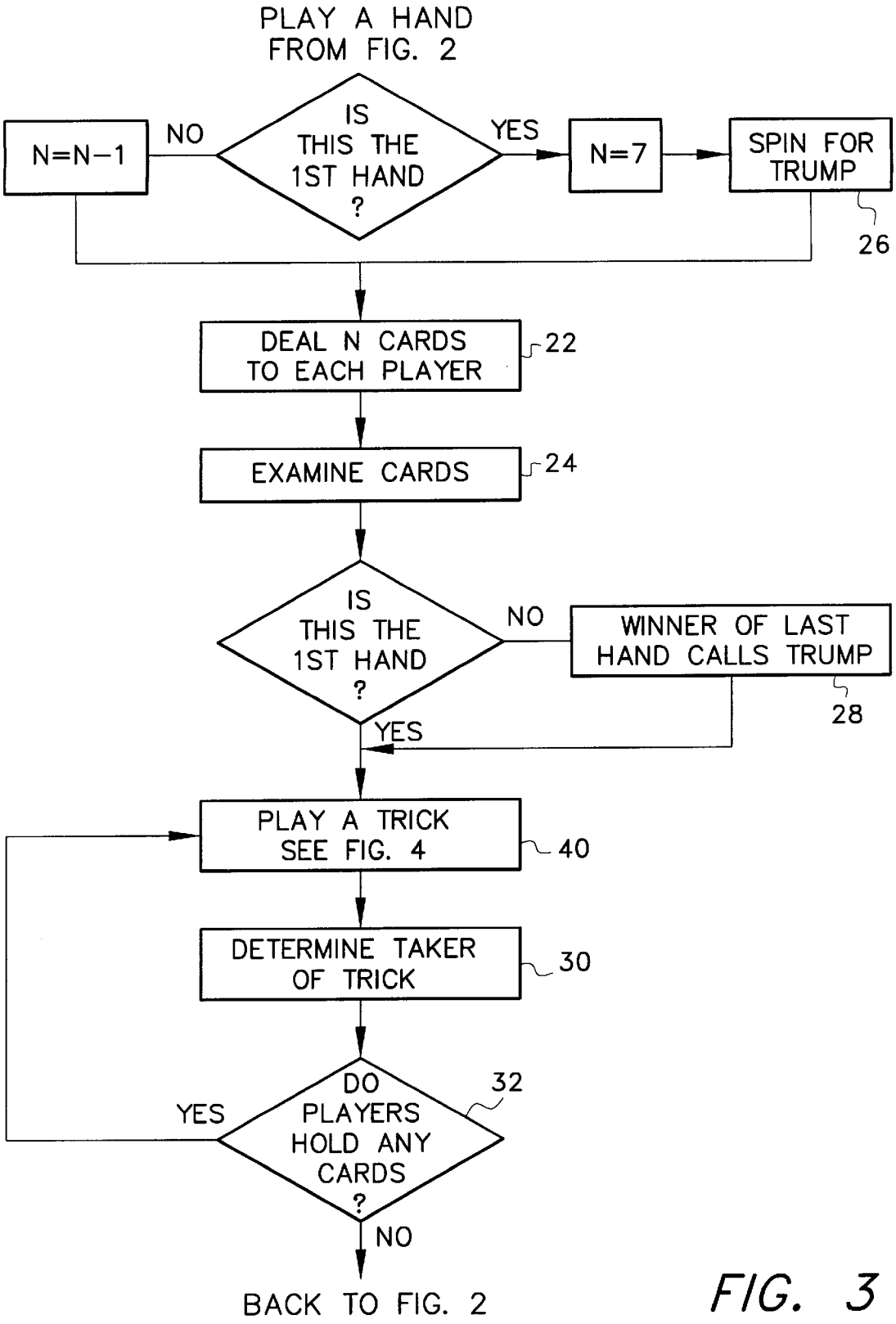
FIG. 3 is a flowchart of one hand of the card game of the present invention.
Figure 4:
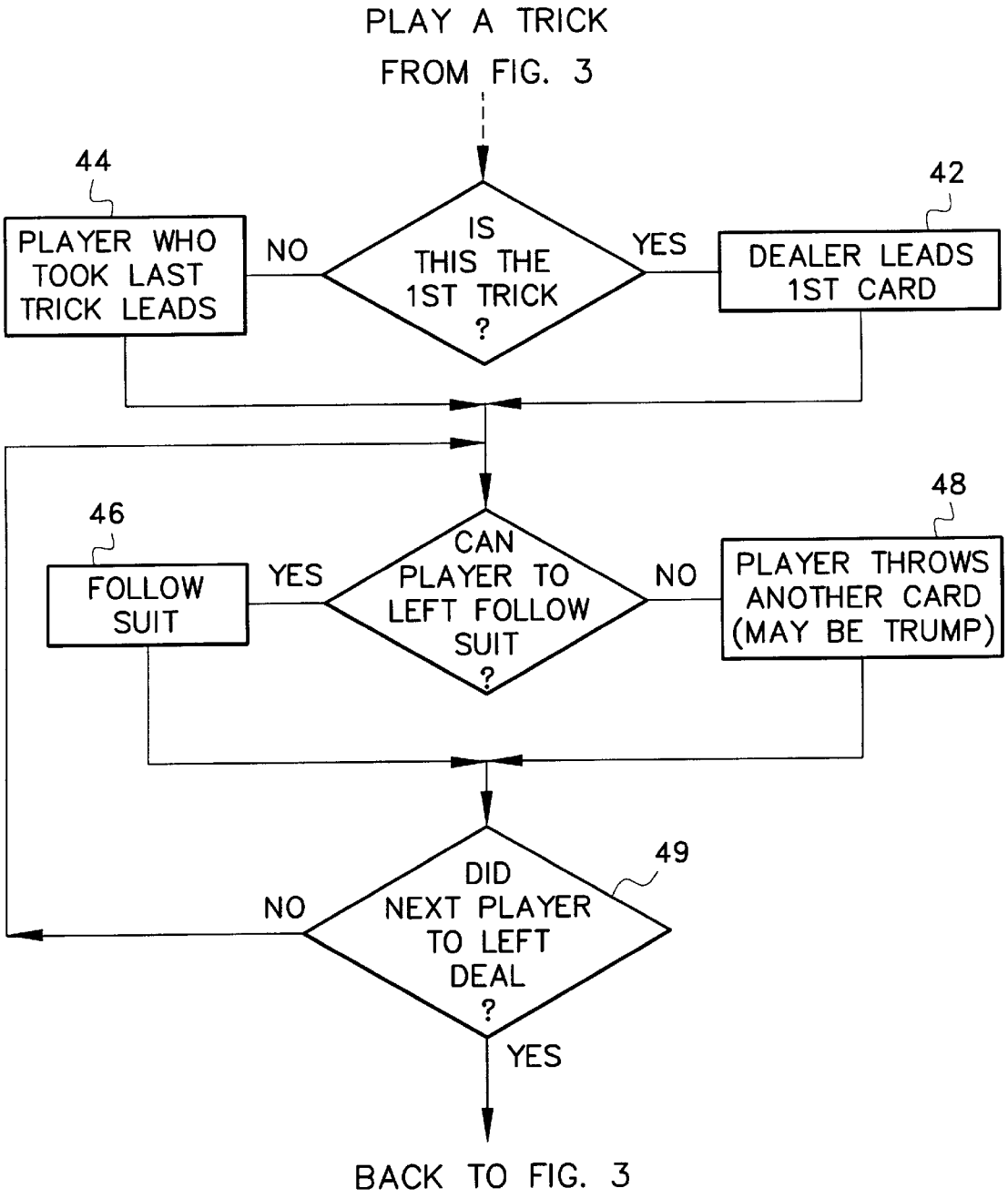
FIG. 4 is a flowchart of one trick of one hand of the card game of the present invention.

The present invention is a spinner device for randomly selecting and tracking a trump suit in a card game, as shown in FIG. 1. FIGS. 2–4 show a flow chart of a new card game of the present invention.

The device 100 for randomly selecting trump comprises a flat planar base member 102 having a plurality of indicia 104 representing the various trump suits. A spacer element 120 is used to raise an indicator 110 off the surface of the base 102. The indicator 110 is a longitudinal member having two ends, one of which is marked as a designating end 112 for pointing to the indicia 104 of a trump suit. The indicator 110, preferably in the shape of an arrow, is attached by conventional means 122, at its midpoint, to the planar base 102. The indicator 110 is attached in such a way that it is free to rotate about the connecting means 122 so that a trump suit may be randomly selected by spinning the indicator 110. The indicator 110 may also be used to merely track a trump suit, when a trump based game is played without need for random selection.

The device 100 may further comprise a means for tracking the number of cards to be dealt each hand, preferably defined by a single bar 130 or groove fixed within the planar base member 102 at or between first 130*a* and second 130*b* ends, and adapted for a slidably attached pointer or indicator 132 having a surface shaped in the form of an arrow or other suitable character or symbol. The pointer 132 indicates a correct number labelled on the base member 102 which corresponds to the number of cards to be dealt. Alternatively, the device can include a peg and hole arrangement for pointing out numbers corresponding to the number of cards to be dealt. However, pegs are difficult to keep, in that they are easily lost or misplaced.

A method for playing the card game is flowcharted in FIGS. 2 through 4. The game may be played with or without the above described trump selector device, but is preferably played using the device. Generally described, the game is played by selecting a series of cards ranking highest over the other cards are designated as "trump." Two to seven players participate by each playing ranked cards to obtain a number of tricks by the player playing the highest ranked card. The game may also be played with traditional rules where the deal follows around to left, and the first play begins to the left of the dealer. It is preferred however that the game be played abandoning these traditional rules as described below. Any variations to these rules should be agreed upon before the start of play.

First, a standard fifty-two card deck of playing cards containing thirteen cards each in four suits designated spades, hearts, diamonds, and clubs must be provided. Preferably, a device for determining and marking trump and the number of cards dealt will also be used. In addition to a standard 52 card deck, the game also incudes a special card. This card is preferably designated as the grand trump card. The value or rank of this card is greater than any other card in the deck and would always be the winner in any hand in which it is played. It is dealt and played like any other card, but would be the card of greatest value or rank. No matter what trump was called or randomly selected the grand trump card wins the trick being played. The game is begun by determining a dealer, 10 FIG. 2, through any conventional means.

Next, a series of hands are played, 20, as detailed in FIG. 3. A number, N, of cards are dealt to each player 22, where N=7 if it is the first hand and N=N−1 in subsequent hands. Each player, then, may examine his hand 24. Trump is called, either by random selection 26 if it is the first hand or by the winner of the previous hand 28 in subsequent hands.

Once trump is called for the given hand, a series of tricks are played 40, as detailed in FIG. 4, wherein each player throws only one card. The first card is lead by the dealer 42 if it is the first trick of this hand or by the winner of the previous trick 44 for all subsequent tricks of this hand. The player to the left must throw a card of the same suit (follow suit) if he can 46. If he cannot follow suit, the player may throw any other card of his choosing 48; it need not be trump. The next player to the left repeats the step of throwing a card, following suit of the first played card (the lead card), until play returns to the lead player 49 and each player has thrown one card, signalling the end of the trick. The player who takes the trick is determined 30 by which player threw the highest card of the suit led or the highest trump thrown, if any.

A number of tricks, corresponding to the number of cards dealt in each hand, are played until each player has no remaining cards 32. This signals the end of the hand. A winner of the hand is determined 50 by counting who took the most tricks. Next it must be determined which players remain in the game 60. A player remains in the game if he took at least one trick in the hand. If the player does not take at least one trick, he is out of the game. Play continues with the remaining players. The winner of the hand now become the dealer, and gets to choose the trump suit after examining his hand.

It is further noted that, in the case of a tie—in the number of tricks taken—those players taking the most tricks (e.g., if five cards were dealt and two players each take two tricks), a cut of the deck will determine the winner of that hand and thus that winner becomes the new dealer.

Play continues through playing subsequent hands, until only one player remains 70. This may happen at any point during the game, but will often occur only when two players remain, each being dealt only one card. The end of the game and a winner are declared when only one player remains.

It is to be understood that the present invention is not limited to the embodiments described above, but encompasses any and all embodiments within the scope of the following claims.

I claim:

1. A card game play device for use during a card game where cards are dealt to players in hands, the card game includes a trump suit, and tricks are turned during the play of each hand; said device comprising:

a base member having a rectangular form, said rectangular form of said base member being divided into a first section and a second section;

said first section having a square form, said square form being divided into quadrants, said square form having a center point; each of said quadrants having symbolic indicia therein;

said symbolic indicia including heart, club, diamond and spade shapes, one of each said shapes being disposed in a respective one of said quadrants, said symbolic indicia representing selectable trump suits;

an indicator having a first end, a second end and a middle portion, said first end having means for randomly pointing to one of said selectable trump suits;

means for pivotally attaching said middle portion of said indicator to said center point of said square form of said base member;

a spacer disposed between said indicator and said base member, said spacer allowing said indicator to rotate freely about said means for pivotally attaching and above said base member;

said second section of said base member having a rectangular form, said second section including means for tracking the number of cards to be dealt in each hand;

said means for tracking the number of cards to be dealt includes numerical indicia and a pointer;

said numerical indicia providing numerical representations in a descending order, said numerical representations beginning at least with seven and ending with one, said numerical representations corresponding to the number of cards to be dealt in the respective hand of the card game;

said pointer being movably attached to said second section of said base member, said pointer selectively indicating said numerical representation of the number of cards dealt in the hand of the card game.

2. The card game play device according to claim 1, further including a bar attached to said second section of said base member adjacent said numerical indicia, said pointer slidably disposed along said bar.

3. The card game play device according to claim 1, further including a groove embedded in said second section of said base member adjacent said numerical indicia, said pointer slidably disposed within said groove.

* * * * *